US005963235A

United States Patent [19]

Chwalek et al.

[11] Patent Number: 5,963,235

[45] Date of Patent: Oct. 5, 1999

[54] CONTINUOUS INK JET PRINTER WITH MICROMECHANICAL ACTUATOR DROP DEFLECTION

[75] Inventors: James M. Chwalek, Pittsford; Gilbert A. Hawkins; Constantine N. Anagnostopoulos, both of Mendon, all of N.Y.

[73] Assignee: Eastman Kodak Company, Rochester, N.Y.

[21] Appl. No.: 08/954,681

[22] Filed: Oct. 17, 1997

[51] Int. Cl.[6] ..... B41J 2/105

[52] U.S. Cl. ..... 347/82

[58] Field of Search ..... 347/77, 82, 73, 347/74, 75

[56] References Cited

U.S. PATENT DOCUMENTS

| | | | |
|---|---|---|---|
| 1,941,001 | 12/1933 | Hansell . | |
| 3,373,437 | 3/1968 | Sweet et al. . | |
| 3,416,153 | 12/1968 | Hertz et al. . | |
| 3,709,432 | 1/1973 | Robertson | 239/4 |
| 3,878,519 | 4/1975 | Eaton | 347/82 |
| 3,916,421 | 10/1975 | Hertz . | |
| 3,979,756 | 9/1976 | Helinski et al. . | |
| 4,148,718 | 4/1979 | Fulwyler . | |
| 4,230,558 | 10/1980 | Fulwyler . | |
| 4,318,483 | 3/1982 | Lombardo et al. . | |
| 4,346,387 | 8/1982 | Hertz . | |
| 4,646,106 | 2/1987 | Howkins . | |
| 5,160,939 | 11/1992 | Bajeux et al. . | |

FOREIGN PATENT DOCUMENTS

| | | | |
|---|---|---|---|
| 002041831 | 9/1980 | United Kingdom | 347/82 |

OTHER PUBLICATIONS

T.P. Weihs, S. Hong, J.C. Bravman, W. D. Nix, J Mater, Mechanical deflection of cantilever microbeams: A new technique for testing the mechanical properties of thin films, Res.3 (5), Sep. 1988, pp. 931–942.

*Primary Examiner*—N. Le
*Assistant Examiner*—Thien Tran
*Attorney, Agent, or Firm*—Milton S. Sales

[57] ABSTRACT

A continuous ink jet printer emits a continuous stream of ink from an ink stream generator. The stream breaks up into a plurality of droplets at a position spaced from the ink stream generator. A stream deflector includs a control surface positioned adjacent to the stream between the ink stream generator and the position whereat the stream breaks up into droplets such that the stream contacts the control surface and is thereby deflected due to a gain in free energy caused by physical contact between the ink in the stream and the control surface. Apparatus may be provided to modulate the position of the control surface to change the direction of the stream between a print direction and a non-print direction.

13 Claims, 6 Drawing Sheets

CONTINUOUS INK JET PRINTER WITH MICROMECHANICAL ACTUATOR DROP DEFLECTION

CROSS REFERENCE TO RELATED APPLICATIONS

Reference is made to commonly assigned, co-pending U.S. patent applications Ser. No. 08/955,562 filed on Oct. 17, 1997 entitled CONTINUOUS INK JET PRINTER WITH ELECTROSTATIC DROP DEFLECTION in the names of J. Chwalek and C. Anagnostopoulos; Ser. No. 08/954,317 filed on Oct. 17, 1997 entitled CONTINUOUS INK JET PRINTER WITH ASYMMETRIC HEATING DROP DEFLECTION in the names of J. Chwalek, D. Jeanmaire, and C. Anagnostopoulos; Ser. No. 08/953,525 filed on Oct. 17, 1997 entitled CONTINUOUS INK JET PRINTER WITH VARIABLE CONTACT DROP DEFLECTION in the names of G. Hawkins, C. Anagnostopoulos, J. Chwalek, and D. Jeanmaire; and Ser. No. 08/953,610 filed on Oct. 17, 1997 entitled CONTINUOUS INK JET PRINTER WITH BINARY ELECTROSTATIC DEFLECTION in the names of J. Chwalek and D. Jeanmaire. All of the above-listed applications are filed concurrently herewith.

FIELD OF THE INVENTION

This invention relates generally to the field of digitally controlled printing devices, and in particular to continuous ink jet printheads which integrate multiple nozzles on a single substrate and in which the breakup of a liquid ink stream into droplets is caused by a periodic modulation of the surface tension of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Inkjet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 to Hansell.

U.S. Pat. No. 3,373,437, which issued to Sweet et al. in 1967, discloses an array of continuous ink jet nozzles wherein ink drops to be printed are selectively charged and deflected towards the recording medium. This technique is known as binary deflection continuous ink jet, and is used by several manufacturers, including Elmjet and Scitex.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture. This technique is used in ink jet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging rings, deflection plates are used to actually deflect drops.

Conventional continuous ink jet utilizes electrostatic charging rings that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. In the current invention, the electrostatic charging plates are unnecessary.

DISCLOSURE OF THE INVENTION

It is an object of the present invention to provide a high speed apparatus and method of page width printing utilizing a continuous ink jet method whereby drop formation and deflection may occur at high repetition.

It is another object of the present invention to provide an apparatus and method of continuous ink jet printing with drop deflection means which can be integrated with the printhead utilizing the advantages of silicon processing technology offering low cost, high volume methods of manufacture.

It is yet another object of the present invention to provide an apparatus and method of high speed printing that can use a wide variety of inks.

It is still another object of the present invention to provide an apparatus and method for continuous ink jet printing that does not require electrostatic charging plates.

According to a feature of the present apparatus, a continuous ink jet printer emits a continuous stream of ink from an ink stream generator. The stream breaks up into a plurality of droplets at a position spaced from the ink stream generator. A stream deflector includs a control surface positioned adjacent to the stream between the ink stream generator and the position whereat the stream breaks up into droplets such that the stream contacts the control surface and is thereby deflected due to a gain in free energy caused by physical contact between the ink in the stream and the control surface. Apparatus may be provided to modulate the position of the control surface to change the direction of the stream between a print direction and a non-print direction.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2(*b*) shows a cross section of the nozzle with drop deflection by micromechanical actuators illustrating stream direction.

FIG. 2(*c*) shows a cross section of the nozzle with drop deflection by toroidal micromechanical actuators.

FIG. 2(*d*) shows a cross section of the nozzle with drop deflection by interdigitated capacitor micromechanical actuators.

FIG. 2(*e*) shows a cross section of the nozzle with drop deflection by piezoelectric micromechanical actuators.

FIG. 3(*b*) is an image, obtained experimentally, of drop breakup of a stream when the drop deflection by micromechanical actuators is in contact with the fluid stream.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
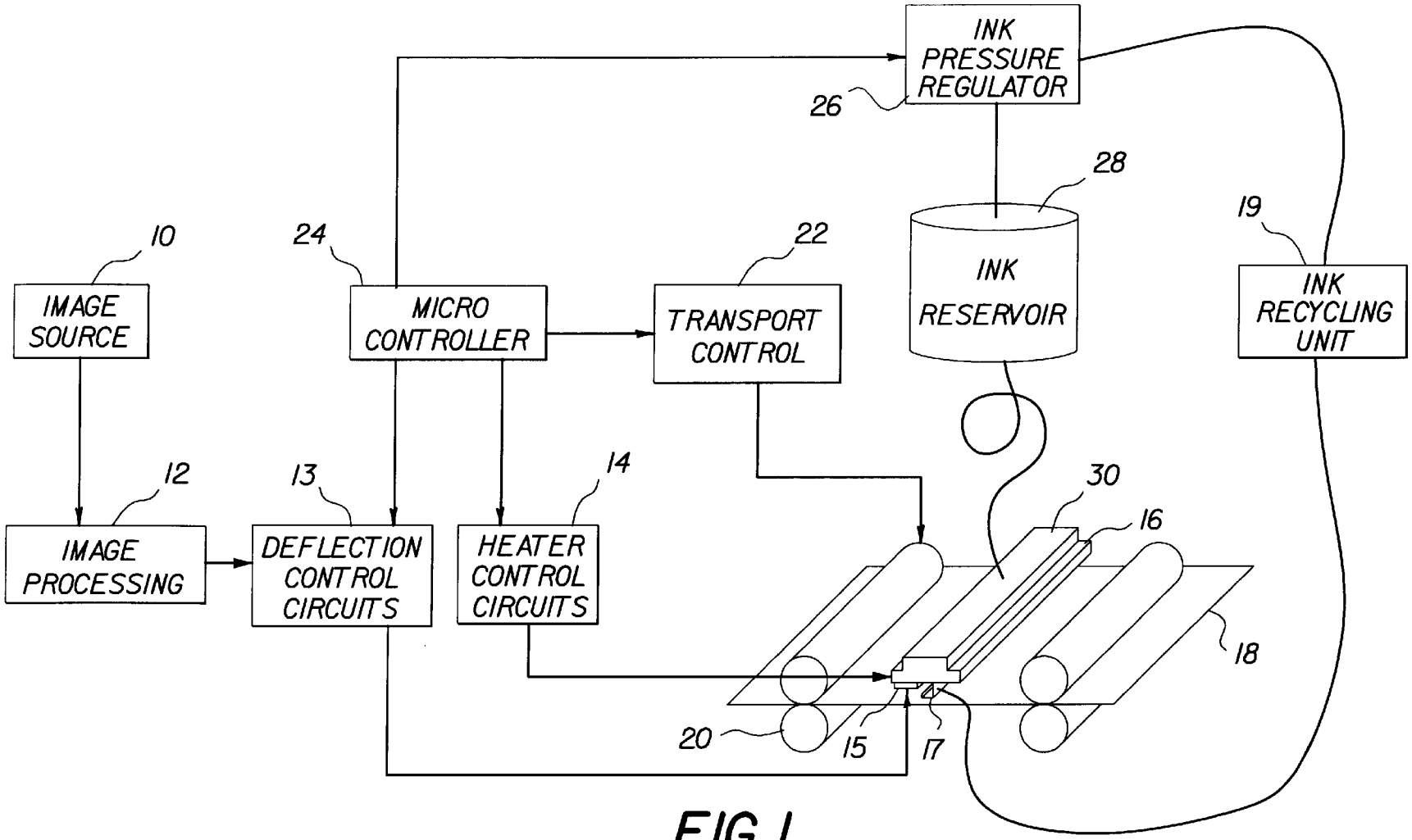
FIG. 1 shows a simplified block schematic diagram of one exemplary printing apparatus according to the present invention.
Figure 2A:
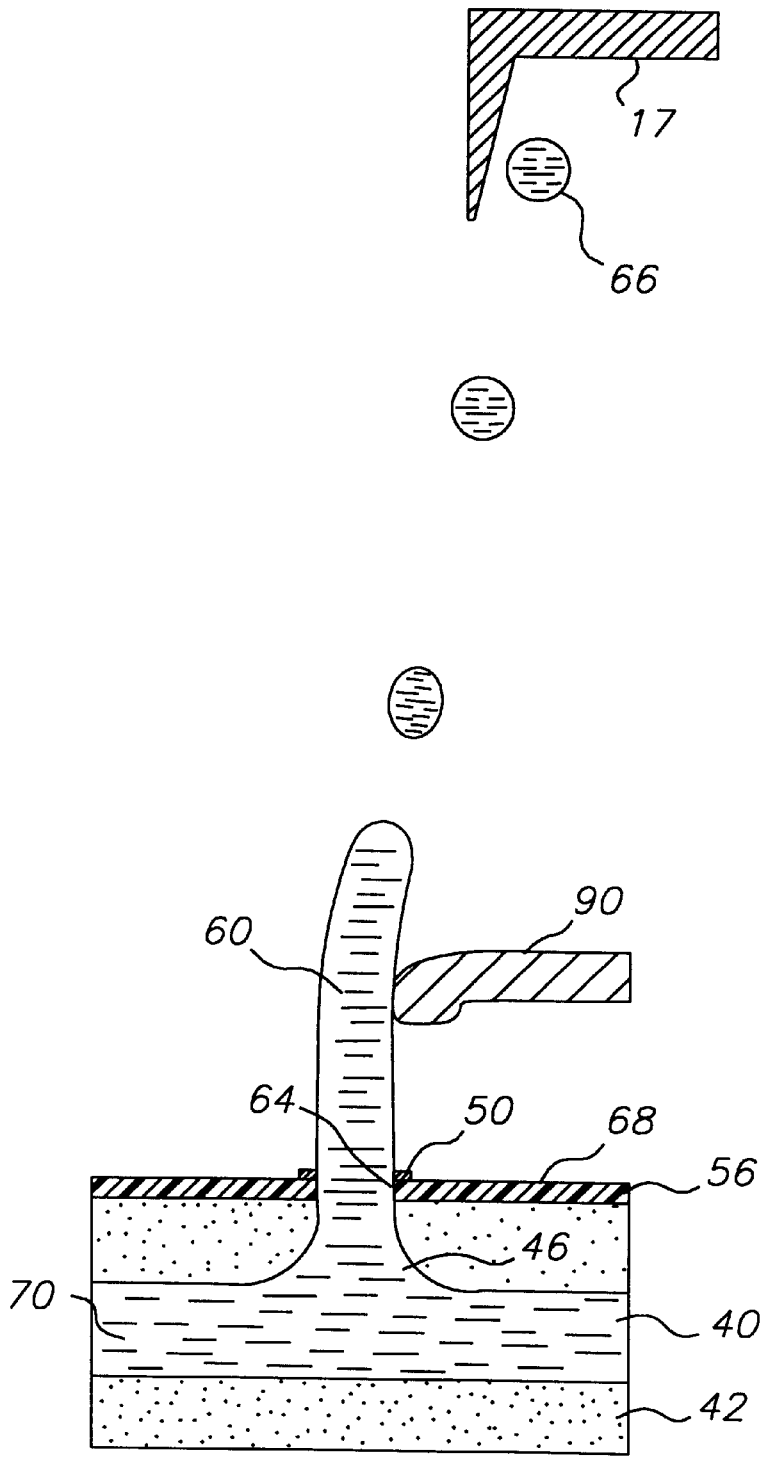
FIG. 2(*a*) shows a cross section of the nozzle with drop deflection by micromechanical actuators.
Figure 2B:
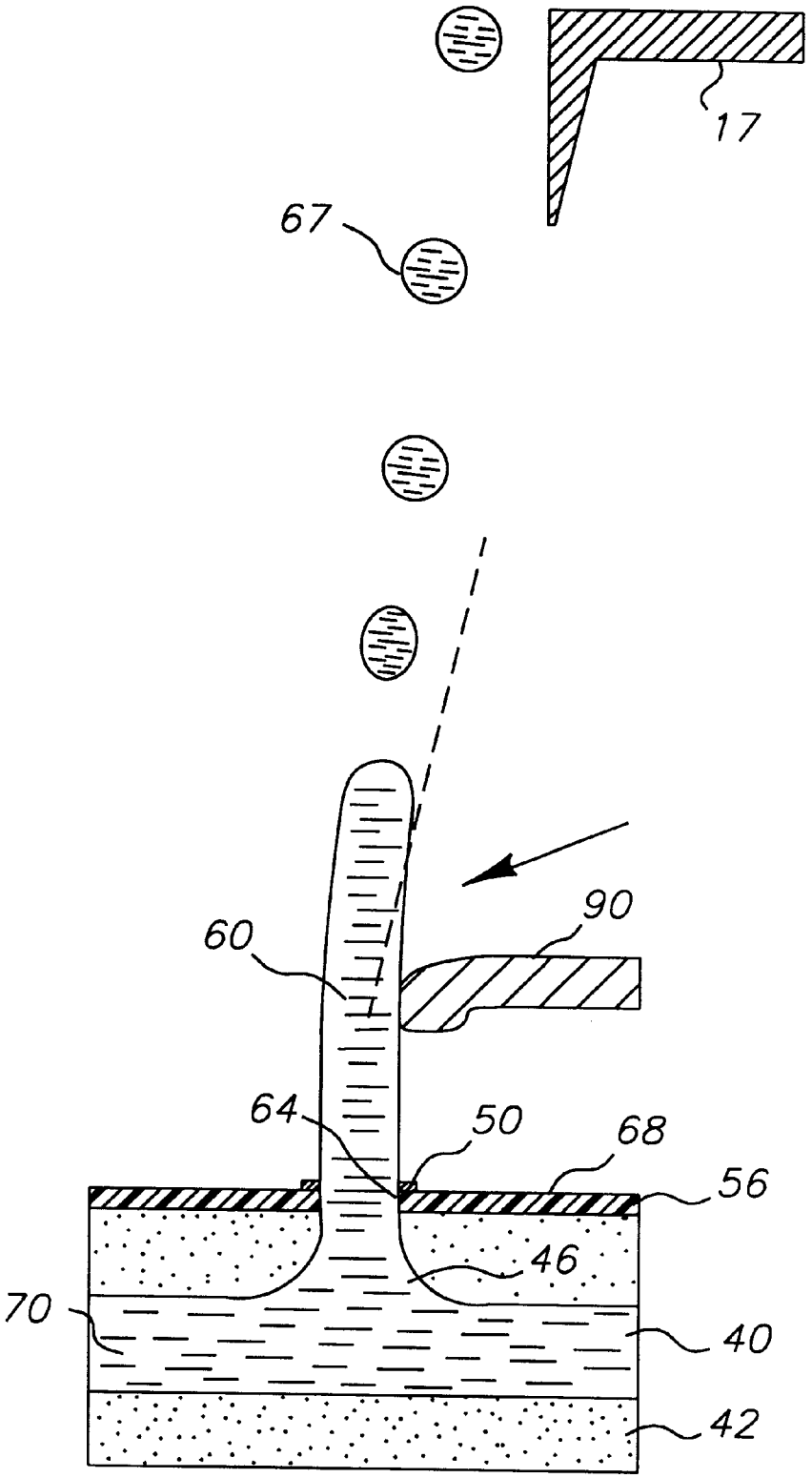
Figure 2C:
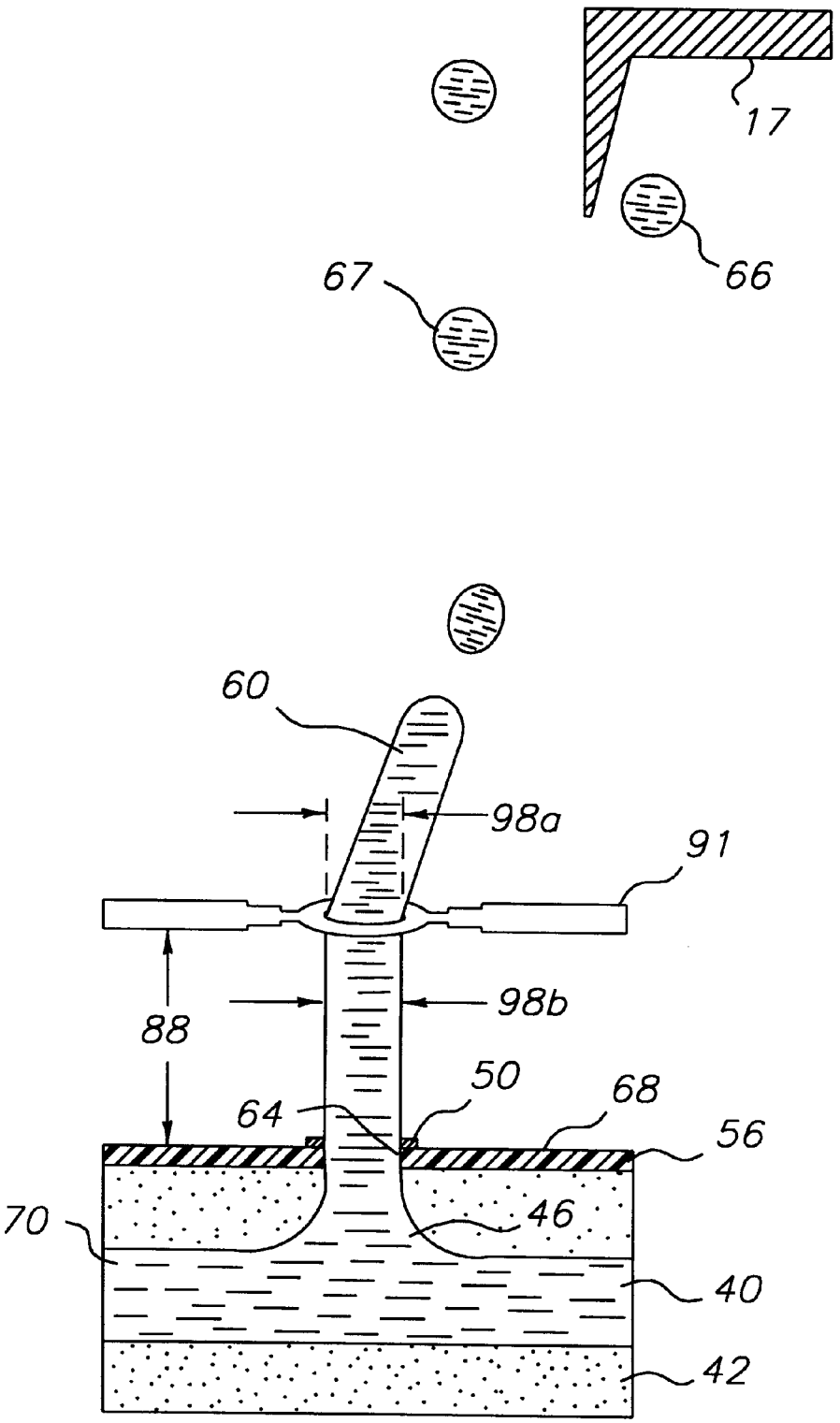
Figure 2D:
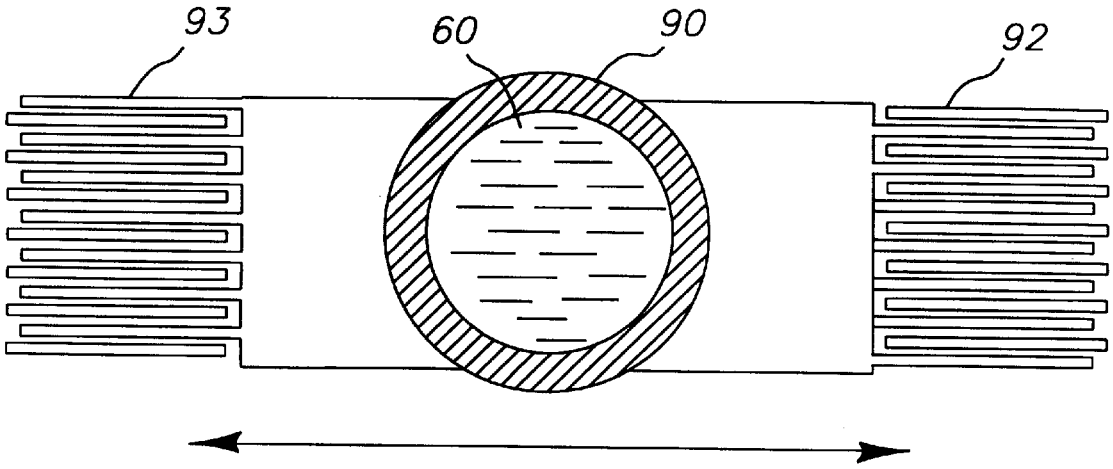
Figure 2E:
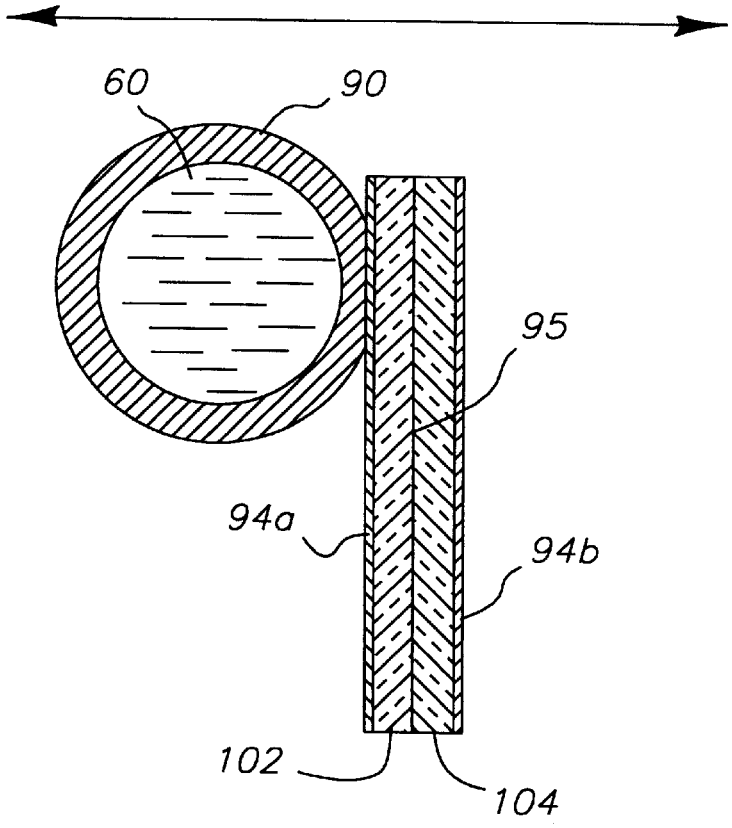

Referring to FIG. 1, a continuous ink jet printer system includes an image source 10 such as a scanner or computer which provides raster image data, outline image data in the form of a page description language, or other forms of digital image data. This image data is converted to halftoned bitmap image data by an image processing unit 12 which also stores the image data in memory. A plurality of drop deflection control circuits 13 read data from the image memory and apply time-varying electrical pulses to a drop deflection means 15. Time-varying electrical pulses are supplied to a plurality of heater control circuits 14 that supply electrical energy to a set of nozzle heaters 50, FIG. 2(*a*), that are part of a printhead 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to printhead 16 by a recording medium transport system 20, and which is electronically controlled by a recording medium transport control system 22, which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along the orthogonal axis (the main scanning direction) in a relative raster motion.

Micro-controller 24 may also control an ink pressure regulator 26, drop deflection control circuits 13, and heater control circuits 14. Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface, where a plurality of nozzles and heaters are situated. With printhead 16 fabricated from silicon, it is possible to integrate drop deflection control circuits 13 and heater control circuits 14 with the printhead.

FIG. 2(*a*) is a cross-sectional view of one nozzle tip of an array of such tips that form continuous ink jet printhead 16 of FIG. 1 according to a preferred embodiment of the present invention. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to heat supplied by a heater 50.

Contact between stream 60 and control a surface 90 in FIG. 2(*a*) causes a deflection of the stream as compared with the direction of flow the stream would assume if control surface 90 were withdrawn from contact with the stream. The stream is deflected in a direction toward the control surface due to the gain in free energy of the system caused by physical contact between the ink and the control surface, as is the case for static liquids which deform their shape upon contact with solid surfaces. The distance from the nozzle to the farthest point of contact of the stream and the surface layer is less than or about the distance from the nozzle to the point in the stream at which the stream breaks into drops due to heat supplied by heater 50 in the absence of control surface 90, in order that the stream remain in cylindrical form when in contact with surface 90 which is the stream deflection means. One aspect of the discovery of this invention is that the break-up of the stream into uniformly spaced discrete drops is not impeded by the presence of the control surface.

In accordance with the present invention, there is always a deflection of the stream. Steering of the stream is accomplished by modulating the deflection through motion of control surface 90, either horizontally or vertically in FIG. 2(*a*). The results of such a motion are shown in FIG. 2(*b*), where the arrow represents the direction of a small displacement, typically about a micron, of control surface 90 relative to its position in FIG. 2(*a*). The dotted line in FIG. 2(*b*) corresponds to the direction of the stream in FIG. 2(*a*), which in accordance with the present invention is altered by displacement of control surface 90.

The extent of deflection for a given motion of the control surface is related to the stream velocity, the stream diameter, the shape of the contact area between the stream and the control surface, and the distance of the control surface from the nozzle. A control surface having a large contact area with a small diameter stream located near the nozzle is preferred. Such a configuration is advantageous in printing high resolution dots. The angle of deflection in this case is primarily given by the lateral displacement of the stream at the control surface divided by the distance of the control surface from the nozzle, as indicated in FIG. 2(*a*). Control surface 90 in the preferred embodiment is shown in FIG. 2(*a*) as a flat surface in contact with steam 60. A control surface may be of other forms as well, including a toroidal control surface 91 surrounding entirely the stream, as shown in FIG. 2(*c*). In such a case, if the internal toroidal diameter 98*a* is about the same or slightly greater, for example 25% greater, than the stream diameter 98*b*, the role of surface free energy will dominate the effects of collision of the stream with the control surface and will minimize the perturbation of the stream by the control surface.

In accordance with this invention, the stream is generally deflected from the position it would occupy compared with the direction of flow the stream would assume if control surface 90 were withdrawn from contact with the stream. The degree of deflection may be selectively altered by changing the horizontal (left-to-right in FIGS. 2(*a*)–(*c*)) or vertical (up-to-down in FIGS. 2(*a*)–(*c*)) position of control surface 90. Alterations of the deflection angle are a result of the minimization of the free energy of the system due to contact between the ink and the control surface. Deflection left in FIG. 2(*a*) may be achieved by positioning the control surface closer to the center of the stream, whereas positioning the control surface away from the steam produces an opposite angular deflection (towards the right), as shown in FIG. 2(*a*). This deflection method is distinct from that of prior art embodiments of continuous stream ink devices, which rely upon deflection of drops previously separated from their respective streams and which require charged droplets for deflection. As is well known in the art, such charging causes interactions between the droplets during subsequent propagation, thereby limiting nozzle density in devices employing arrays of nozzles.

A lateral displacement of the control surface will result in a large deflection angle change if the contact area is large, if the distance 88 of the control surface from the nozzle is small, and if the velocity of the stream is small. A large contact area maximizes the surface tension forces between the stream and the control surface, a small distance 88 between the nozzle and the control surfaces leverages the lateral displacement of the control surface, providing the stream and the control surface move together. The velocity, and hence momentum, of the stream determines how large a momentum change must be provided by the surface tension forces; the larger the momentum change required, the smaller the angle of deflection. These parameters are subject to device design and operation and may be controlled to achieve maximum stream deflection angles.

Means for causing a lateral displacement of control surface 90 are preferably chosen from means commonly employed for displacement of microstructures by voltage actuation, preferably means which may be also accomplished in a small spatial extent, in order that an array of nozzles and associated control surfaces may be fabricated in close proximity. Such means include electrostatic displacement, differential thermal expansion, phase change means, and piezo electric actuator means.

FIG. 2(*d*) shows a control surface 90 which is caused to move by application of a voltage to interdigitated capacitors 91 and 92, a device well known in the art of microdisplacement motors. Such means can be moved rapidly, having response times less than ten microseconds per micron of motion and have forces larger than those due to the surface tension forces holding the stream to the control surface. Typical response times of electrostatic motors may be as small as a few microseconds. Such rapid responses are advantageous for applications involving high speed printing. An alternative means for causing motion of control surface 90 also relying on integrated circuit technology for fabrication is a microdisplacement motor made on the principal of the "bimetallic strip," in which differential heating of two closely spaced parts causes a bending motion perpendicular to the length of the parts. A description of the fabrication of such devices is given by T. P. Weihs, S. Hong, J. C. Bravman, and W. D. Nix, J. Mater. Res. 3 (5), September 1988, pp. 931. FIG. 2(*e*) shows a control surface 90 which is caused to move by application of a voltage between opposing electrodes 94*a* and 94*b* to a piezoelectric element 95, a device also well known in the art of microdisplacement motors. To deflect the beam a large distance, a stack of piezo elements may be used, as is well known in the art, or a bimorph comprising a layer of piezo material 102 of a first polarization (for example left in FIG. 2(*e*)) bonded to a piezo material 104 of a second polarization (for example right in FIG. 2(*e*)) may be employed, as is also widely known in the art of piezo electric actuators. Piezoelectric elements, for example rectangular pieces made from polarized PZT (lead zirconate titanate) having electrodes applied to opposing surfaces move rapidly, with typical response times which may be as small as a few microseconds. Such rapid responses are advantageous for applications involving high speed printing. Other means are also available for moving control surface 90 and lie within the scope and spirit of this invention.

Although an array of streams is not required in the practice of this invention, a device comprising an array of streams may be desirable to increase printing rates. In this case, deflection and modulation of individual streams may be accomplished as described for a single stream in a simple and physically compact manner, because such deflection relies only on application of a small potential, which is easily provided by conventional integrated circuit technology, for example CMOS technology.

Experimental Results

Figure 3A:
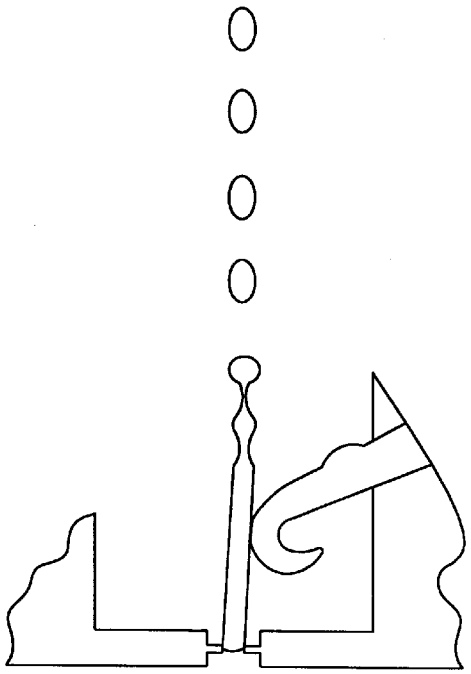
FIG. 3(*a*) is an image, obtained experimentally, of drop breakup of a stream when the drop deflection by micromechanical actuators is not in contact with the fluid stream.
Figure 3B:
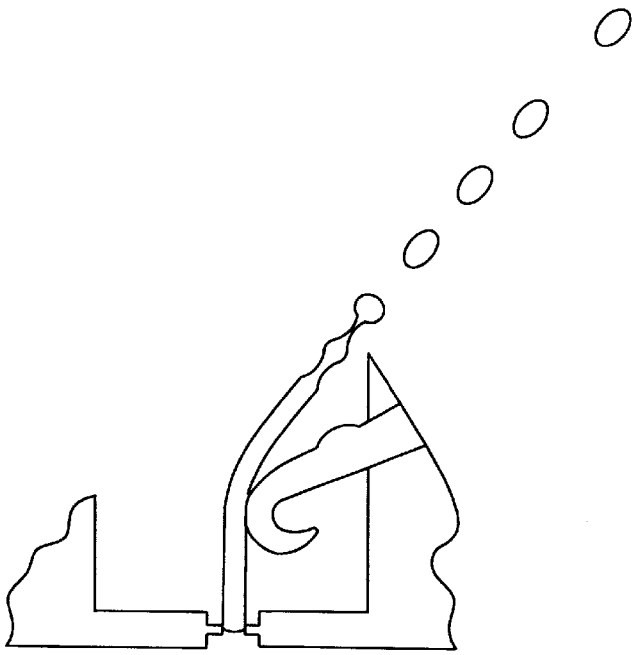

A printhead 16 with 16 $\mu$m diameter nozzles was fabricated as described above. A tungsten metal probe was placed in the vicinity of stream 60. The probe's distance was controlled by use of an mechanical actuator. An ink reservoir and pressure control means was used to control the pressure of stream 60. A fast strobe and a CCD camera were used to freeze the image of the drops in motion. A heater power supply was used to provide a current pulse to heater 50. The ink reservoir was filled with DI water and a pressure of 68.9 kPa (10 lbs/in$^2$) was applied, forming a stream 60. A pulse train of 400 ns pulses at a repetition rate of 98 KHz and a power of 96 mW was applied to heater 50, causing the stream to break up into a series of regularly spaced drops, as can be seen in FIG. 3(*a*). When the probe was brought into contact with the stream, drops were seen to deflect (FIG. 3(*b*)).

The invention has been described in detail with particular reference to preferred embodiments thereof, but it will be understood that variations and modifications can be effected within the spirit and scope of the invention.

What is claimed is:

1. Apparatus for controlling ink in a continuous ink jet printer in which a continuous stream of ink is emitted from a nozzle; said apparatus comprising:

an ink stream generator which establishes a continuous flow of ink in a stream, said stream breaking up into a plurality of droplets at a position spaced from the ink stream generator; and a stream deflector including a toroidal-shaped control surface positioned adjacent to the stream between the ink stream generator and the position whereat the stream breaks up into droplets such that the stream contacts the control surface and is thereby deflected due to a gain in free energy caused by physical contact between the ink in the stream and the control surface.

2. Apparatus as set forth in claim 1, wherein the ink in the stream contacts the control surface from only one side of the stream.

3. Apparatus as set forth in claim 1, further comprising apparatus to modulate the position of the control surface to change the direction of the stream between a print direction and a non-print direction.

4. Apparatus as set forth in claim 3, wherein the position of the control surface is modulated generally orthogonal to the direction of flow of the ink in the stream.

5. Apparatus as set forth in claim 3, wherein the position of the control surface is modulated generally parallel to the direction of flow of the ink in the stream.

6. Apparatus as set forth in claim 3, wherein the position of the control surface is modulated by selective application of a voltage to a set of interdigitated capacitors.

7. Apparatus as set forth in claim 3, wherein the position of the control surface is modulated by a piezoelectric microdisplacement motor.

8. Apparatus as set forth in claim 1, wherein the ink stream generator comprises:

an ink delivery channel;

a source of ink communicating with the ink delivery channel, wherein the ink is pressurized above atmospheric pressure; and a nozzle bore which opens into the ink delivery channel.

9. Apparatus for controlling ink in a continuous ink jet printer in which a continuous stream of ink is emitted from a nozzle; said apparatus comprising:

an ink stream generator which establishes a continuous flow of ink in a stream;

a droplet generator which causes the stream to break up into a plurality of droplets at a spaced position from the ink stream generator; and a stream deflector including a toroidal-shaped control surface positioned adjacent to the stream between the ink stream generator and the position whereat the stream breaks up into droplets such that the stream contacts the control surface and is thereby deflected due to a gain in free energy caused by physical contact between the ink in the stream and the control surface.

10. Apparatus as set forth in claim 9, wherein the droplet generator is a heater.

11. A process for controlling ink in a continuous ink jet printer in which a continuous stream of ink is emitted from a nozzle; said process comprising:

establishing a continuous flow of ink in a stream which breaks up into a plurality of droplets at a position spaced from the nozzle; and contacting the stream by a toroidal-shaped control surface positioned adjacent to the stream between the nozzle and the position whereat the stream breaks up into droplets such that the stream is deflected due to a gain in free energy caused by physical contact between the ink in the stream and the control surface.

12. The process as set forth in claim 11, wherein the step of establishing a continuous flow of ink in a stream comprises:

providing an ink delivery channel;

providing a source of ink communicating with the ink delivery channel;

pressurizing the ink in the delivery channel above atmospheric pressure; and providing a nozzle bore which opens into the ink delivery channel.

13. Apparatus for controlling ink in a continuous ink jet printer in which a continuous stream of ink is emitted from a nozzle; said apparatus comprising:

an ink stream generator which establishes a continuous flow of ink in a stream, said stream breaking up into a plurality of droplets at a position spaced from the ink stream generator;

a stream deflector including a control surface positioned adjacent to the stream between the ink stream generator and the position whereat the stream breaks up into droplets such that the stream contacts the control surface and is thereby deflected due to a gain in free energy caused by physical contact between the ink in the stream and the control surface; and apparatus to modulate the position of the control surface generally parallel to the direction of flow of the ink in the stream to change the direction of the stream between a print direction and a non-print direction.

* * * * *